US006245287B1

(12) United States Patent
Kokubo et al.

(10) Patent No.: US 6,245,287 B1
(45) Date of Patent: Jun. 12, 2001

(54) MOLTEN METAL VESSEL AND MOLTEN METAL HOLDING FURNACE

(75) Inventors: Hideo Kokubo, Tsurugashima; Hirohito Ishida, Sayama; Zinpachi Kawasaki, Kasugai, all of (JP)

(73) Assignee: Nippon Crucible, Co., Ltd., Tokyo (JP)

( * ) Notice: Subject to any disclaimer, the term of this patent is extended or adjusted under 35 U.S.C. 154(b) by 0 days.

(21) Appl. No.: 09/056,847

(22) Filed: Mar. 24, 1998

(51) Int. Cl.[7] ..... C21B 3/00; C21B 7/06
(52) U.S. Cl. ..... 266/275; 266/280
(58) Field of Search ..... 266/275, 280, 266/286; 432/264, 265

(56) References Cited

U.S. PATENT DOCUMENTS 3,345,059 10/1967 Swindt .
4,160,796 * 7/1979 Lirones ..... 266/275
4,205,197 * 5/1980 Omori et al. ..... 266/275

OTHER PUBLICATIONS

Derwent Abstract 1988–003356 of Japanese Patent document JP62267047A, Jan. 1988.*

* cited by examiner

*Primary Examiner*—Scott Kastler
(74) *Attorney, Agent, or Firm*—Varndell & Varndell, PLLC

(57) ABSTRACT

The present invention is directed to molten metal vessels and molten metal holding furnaces containing a molten metal vessel. The molten metal vessel has a double-layer structure that includes an inner layer vessel in the form of a nonoxide-containing fired casting, and an outer vessel layer made from a calcium silicate refractory. The inner layer of nonoxide-containing fired casting can be obtained by firing in a reduced atmosphere a box-shaped vessel having an open upper side and prepared by casting a monolithic refractory comprising primarily of a silicon carbide material or silicon nitride material. The outer vessel layer of calcium silicate refractory can be obtained by casting calcium silicate monolithic refractory around the inner vessel layer, and thereafter curing, solidifying and drying the resulting casting.

11 Claims, 2 Drawing Sheets

MOLTEN METAL VESSEL AND MOLTEN METAL HOLDING FURNACE

TECHNICAL FIELD

The present invention relates to molten metal vessels and molten metal holding furnaces, and more particularly to vessels and holding furnaces suitable for holding melts of metals (including alloys) having a relatively low melting point, such as aluminum and zinc.

BACKGROUND ART

Conventional holding furnaces for accommodating melts of metals of a relatively low melting point, such as aluminum, generally have a lining of multilayer structure formed inside a shell case and comprising an outer refractory layer, an intermediate heat-insulating layer and an inner vessel layer for holding the molten metal in contact therewith. Stated more specifically, the lining is formed usually by lining the shell case with heat-insulating bricks, castable refractory or the like to provide the refractory layer, covering the refractory layer with a highly heat-insulating material such as heat-insulating bricks or heat-insulating fibers to form the heat-insulating layer, and further forming the vessel layer from ceramic board, castable refractory or the like (see, for example, JP-A No. 18248/1979 and Unexamined Japanese Utility Model Publication N. 30998/1985).

However, the molten metal holding furnace wherein heat-insulating bricks or heat-insulating fibers are used for the heat-insulating layer has the problem of failing to prevent the molten metal reaching the heat-insulating layer from penetrating into this layer, being insufficient in the heat-insulating properties of the heat-insulating material to necessitate an increased thickness for the heat-insulating layer and increase the size of the furnace, and requiring skill for the lining work.

Silica boards, castable refractories and the like which are in wide use for forming the vessel layer (lining wall) for containing the molten metal further have the problem of being liable to react with molten aluminum or with fluxes for treating molten metals. The reaction product is likely to cause formation of aluminum oxide or to produce hard spots by becoming incorporated into the resulting aluminum casting or to locally remove the surface of the inner furnace wall when dislodged from the wall. Stated in greater detail, the hard spot is the reaction product of molten aluminum and/or slag with the ceramic lining wall, consists mainly of molten metal oxide, nonmetallic inclusions and primary crystal metal and itself appears black because silica in the ceramic material is reduced to black silicon by aluminum. The hard spot has a very high hardness (about 2500 in Hv) and a high melting point (about 2000° C.) and is therefore extremely difficult to remove. Accordingly, dislodging the hard spot from the lining wall frequently breaks the lining wall. The hard spot incorporated into the cast aluminum product renders the product faulty, so that it is very important to diminish the hard spots in affording the product in an improved yield.

Further in the case where silica board of high porosity is used for the lining wall, the flux for use in treating molten metal penetrates into the board, permitting the sodium component thereof to react with a component of the board and effecting the vitrification reaction of the board. When vitrified, the silica board exhibits impaired corrosion resistance to the molten metal, permitting seepage of the molten metal and cracking of the lining wall. The vitrified layer is higher than the base material in thermal conductivity, allowing a rise in the surface temperature of the shell case providing the outer periphery of the holding furnace and causing an increased amount of heat dissipation to result in an increased amount of power consumption for heating. Silica board is commercially available in the form of panels, which are joined to one another for use in lining. Accordingly, the board also has the drawback of necessitating skill for the lining work and permitting leakage of molten metal through the joint owing to the thermal stress repeatedly acting during use.

On the other hand, lining materials require a long period of time for drying when they are monolithic refractories containing a large amount of water (about 30 to 60 wt. %), such as castable refractories and calcium silicate slurries, because the lining material is positioned inside the outer peripheral shell case, has its outer periphery hermetically covered and therefore needs drying by heating from one side, i.e. from inside. If dried within a short period of time by rapid heating, the lining wall develops cracks and becomes damaged owing to the shrinkage of the material.

To solve the foregoing problems, proposals have been made which include a lining structure wherein a dry ramming material (up to 1% in water content) is used without addition of water to form a lining wall for use in molten metal vessels (Unexamined Japanese Utility Model Publication No. 1553/1990), and simplified lining techniques for forming a lining wall from an integral bath which is obtained first by a separate process, i.e., by shaping an integral structure from a monolithic refractory, followed by drying and firing (see JP-A No. 224289/1983, Unexamined Japanese Utility Model Publication No. 120526/1986, and JP-A No. 69744/1995).

However, the use of the ramming material involves a heavy burden of labor because the ramming material, which is almost free from water, encounters difficulty in ramming work which is essential to the formation of a homogeneous and compact lining. When the integral bath is used, there arises the problem that if the bath develops a crack, molten metal leaks out through the crack, in addition to the problem of penetration of the molten metal.

To inhibit hard spots, it has also been proposed to use a graphite-containing bath or to use a graphite crucible as an inner vessel (see JP-A No. 33486/1985 and Unexamined Japanese Utility Model Publication No. 67894/1991).

The graphite-containing bath is excellent in corrosion resistance and less likely to react with slag or flux and to produce hard spots, and therefore has the advantage of being usable for satisfactory casting. However, when developing a crack and permitting leakage of molten metal to the outside, the graphite-containing bath has the risk of causing the molten metal to melt the heat-insulating material within a short period of time and to leak out. If it is attempted to increase the graphite and silicon carbide contents to give improved resistance to thermal impact and to corrosion, higher thermal conductivity will result, entailing the problem of a reduction in the temperature of the molten metal due to the dissipation of heat. Thus, there are limitations on the improvement of characteristics by increasing the contents.

Further since the molten metal holding furnace is usually in the form of a box having a thin wall and a large opening, the lining material of furnace requires high costs in designing and making the mold, and extreme difficulties are encountered in preparing the graphite crucible by press forming. There are a wide variety of holding furnaces because they are not standardized in capacity, dimensions, etc. This leads to the problem that it is also economically difficult to prepare molds in conformity with the different kinds of furnaces.

DISCLOSURE OF THE INVENTION

The main object of the present invention is to provide a molten metal vessel and a molten metal holding furnace having the following advantages.

(a) The lining wall is low in reactivity with molten metals, fluxes and slags and therefore less susceptible to the deposition of oxides.

(b) High heat-insulating properties to reduce the power consumption for heating.

(c) The vessel permits no leakage or seepage of the molten metal.

(d) The furnace can be lined within a short period of time.

(e) The lining wall is excellent in strength against impact and corrosion resistance.

(f) The lining wall has high strength to remain undamaged if worked on for the removal of deposits.

(g) The furnace is easy to construct.

We have conducted research while directing attention to the foregoing problems of the prior art and consequently found that a molten metal holding furnace comprising a molten metal vessel of specified double-layer structure exhibits excellent performance.

Stated more specifically, the present invention provides the molten metal vessel and molten metal holding furnace to be described below.

1. A molten metal vessel characterized in that the vessel has a double-layer structure which comprises an inner vessel layer in the form of a nonoxide-containing fired casting, and an outer vessel layer formed from a calcium silicate refractory around the inner vessel layer integrally therewith by casting.
2. A molten metal holding furnace characterized in that the furnace comprises a molten metal vessel installed inside a shell case, at least with a primary heat-insulating layer of superinsulation material provided between the vessel and the shell case, the molten metal vessel comprises an inner vessel layer in the form of a nonoxide-containing fired casting, and an outer vessel layer formed from a calcium silicate refractory around the inner vessel layer integrally therewith by casting.

According to the present invention, the inner vessel layer in the form of a nonoxide-containing fired casting is obtained by firing in a reduction atmosphere a box-shaped vessel having an open upper side and prepared by casting an monolithic refractory consisting primarily of a silicon carbide material or silicon nitride material.

The outer vessel layer formed from a calcium silicate refractory is obtained by casting a calcium silicate monolithic refractory around the inner vessel layer, and thereafter curing, solidifying and drying the casting.

The molten metal vessel and the molten metal holding furnace of the present invention are suitable especially for accommodating melts of metals having a low melting point, such as aluminum, zinc and alloys of these metals.

BEST MODE OF CARRYING OUT THE INVENTION

The present invention will be described below in greater detail with reference to the drawings.

Figure 1:
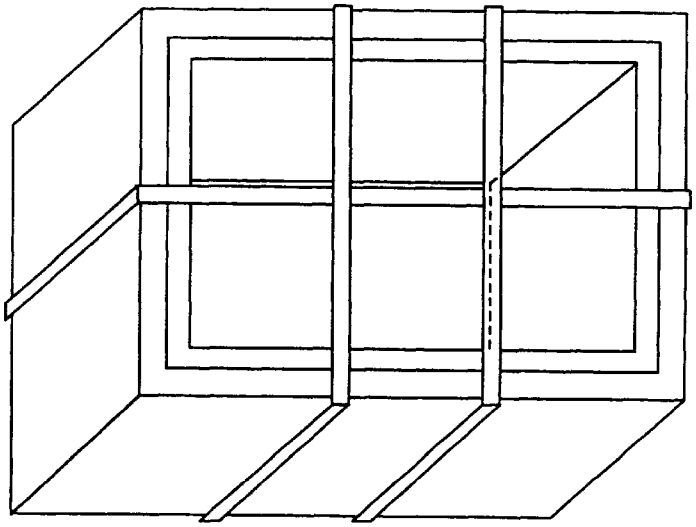
FIG. 1 is a perspective view showing an example of molten metal vessel having a double-layer structure and embodying the invention as the vessel is seen from above.

FIG. 1 is a perspective view showing an example of molten metal vessel 5 of the invention as it is seen from above. The vessel 5 has a double structure comprising an inner vessel layer 1 in the form of a nonoxide-containing fired casting, and an outer vessel layer 3 prepared from a calcium silicate refractory and cast around the vessel layer 1 integrally therewith.

The inner vessel layer 1 in the form of a nonoxide-containing fired casting is prepared by a usual method, i.e., by pouring a monolithic refractory of specified composition into a mold made of foam polystyrene, curing, solidifying and drying the refractory, thereafter removing the foam polystyrene mold to obtain a box-shaped vessel having an open upper side, and firing the vessel in a reduction atmosphere at a predetermined temperature. Examples of materials useful for the nonoxide-containing fired casting are a silicon carbide material and silicon nitride material.

Since these materials can be cast, there is no need for an expensive mold which is difficult to machine. Large vessel or vessels of complex shape can be produced with ease using molds of polystyrene which are inexpensive and easy to make.

Further since the silicon carbide material or silicon nitride material is fired in a reduction atmosphere, the main component of the material, i.e., silicon carbide or silicon nitride, is kept without oxidation. Consequently, the layer remains unreacted with molten metal, such as molten aluminum, even when exposed thereto. The layer has high corrosion resistance, which renders the layer less susceptible to the deposition of hard spots, while the deposits are readily removable. The material has high thermal conductivity, which permits transfer of heat from a heater 19 (see FIG. 2) disposed at an elevated position to the surface of the vessel and to the molten metal. This produces an effect to diminish the temperature difference between upper and lower portions of the molten metal. Although the high thermal conductivity of the silicon carbide or silicon nitride material results in a temperature drop due to the radiation of heat from the molten metal, the radiation of heat can be minimized by the superinsulation material of excellent heat-insulating properties and calcium silicate refractory which are used in combination according to the invention as will be described below.

Although these silicon carbide and silicon nitride materials are not limited specifically in composition, Table 1 shows examples of their compositions. In the tables to follow, the values are in wt. %. Since inevitable impurities are not given in the following tables, the total of the contents of components is not always 100%.

TABLE 1

| | $Al_2O_3$ | $SiO_2$ | SiC | $Si_3N_4$ |
|---|---|---|---|---|
| Silicon carbide material | 3–37 | 2–7 | 57–95 | — |
| Silicon nitride material | 3–37 | 2–7 | — | 57–95 |

In the case where the vessel is to be used under severe conditions or especially good results are desired, it is preferable to use a material containing at least 80% of silicon carbide or silicon nitride.

Subsequently, the outer vessel layer 3 of calcium silicate refractory can be formed by placing the inner vessel layer 1, in the form of a nonoxide-containing fired casting and obtained by the foregoing procedure, into a mold of foam polystyrene prepared in advance, with the opening side down, pouring a calcium silicate monolithic refractory into the mold to cast an outer layer around the inner vessel layer 1, curing and solidifying the resulting outer layer, removing the foam polystyrene mold from the outer layer and drying the casting at about 150 to about 300° C. In this way, the molten metal vessel 5 is obtained which has a double structure, i.e., inner and outer two layers. The molten metal vessel 5 can be prepared within a plant under strictly controlled conditions.

While the composition of the calcium silicate monolithic refractory is not limited specifically either, Table 2 shows an exemplary composition. Such a calcium silicate monolithic refractory composition can be prepared by adding a suitable amount (e.g., about 40%) of water, for example, to a mixture of wollastonite, alumina cement, etc. to obtain a slurry.

TABLE 2

| | $Al_2O_3$ | $SiO_2$ | CaO |
|---|---|---|---|
| Calcium silicate monolithic refractory | 20–50 | 15–45 | 57–95 |

Since wollastonite has an acicular fibrous structure, the use of large amount of water produces numerous voids in the calcium silicate refractory casting on drying to give high heat-insulating properties. Furthermore, the outer vessel layer 3 of calcium silicate refractory has high resistance to corrosion and to heat, so that even if molten metal comes into direct contact with the outer vessel layer 3 upon penetrating through a crack in the inner vessel layer 1 of nonoxide-containing fired casting, the layer 3 prevents further penetration, thus assuring the molten metal vessel 5 of remarkably improved safety.

To render the molten metal vessel 5 of FIG. 1 easy to transport or move, a required number of bands 7 and 9 having high strength and serving as hanging means are provided around the vessel. The vessel 5 is transported, as suitably packaged when necessary, to a site of melting a metal, e.g., aluminum, and installed in a shell case (not shown) along with the heat-insulating layers to be described below for use as a molten metal holding furnace. The bands of e.g., polypropylene resin, are woven of resin fibers and have a suitable width and a thickness of up to several millimeters. Such bands are small in thickness, will not become an obstacle in building up the holding furnace, and will disappear within a short period of time when the furnace is heated and placed into use.

Figure 2:
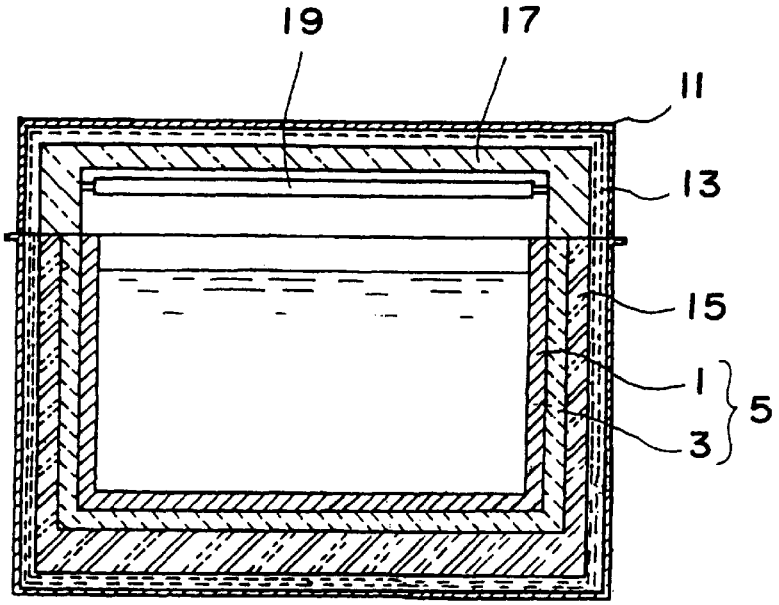
FIG. 2 is a view in vertical section showing a molten metal holding furnace embodying the invention and comprising the vessel shown in FIG. 1.

FIG. 2 is a view in vertical section of a molten metal holding furnace as an embodiment of the invention. According to the embodiment, the furnace comprises a primary heat-insulating layer 13 of superinsulation material, a secondary heat-insulating layer 15 of ceramic board and a molten metal vessel 5 which are installed, as arranged from outside inward, within a shell case 11.

According to the invention, the term "superinsulation material" refers to a heat-insulating material having a thermal conductivity of up to 0.03 kcal/m.hr. °C. More specifically, the superinsulation material is, for example, a superinsulation refractory composition (brand name, "MICROTHERM," product of Nippon Microtherm Co., Ltd.) which comprises superfine particulate silica having a mean particle size of about 5 to about 12 nm and containing at least 99.8% of $SiO_2$, and an inorganic fibrous substance and a finely divided infrared opacifier admixed with the silica.

Examples of useful ceramic boards are silica boards and alumina boards. Silica boards are more preferable because they are amenable to machining such as cutting and boring. The preferred silica board is, for example, one having the composition of Table 3 and usable at temperatures of up to 1000° C.

TABLE 3

| | $Al_2O_3$ | $SiO_2$ | CaO | Others ($TiO_2$, etc.) |
|---|---|---|---|---|
| Silica board | 0–9 | 30–50 | 20–55 | 20–50 |

The molten metal holding furnace shown in FIG. 2 can be closed with a closure 17 equipped with a heater 19.

Figure 3:
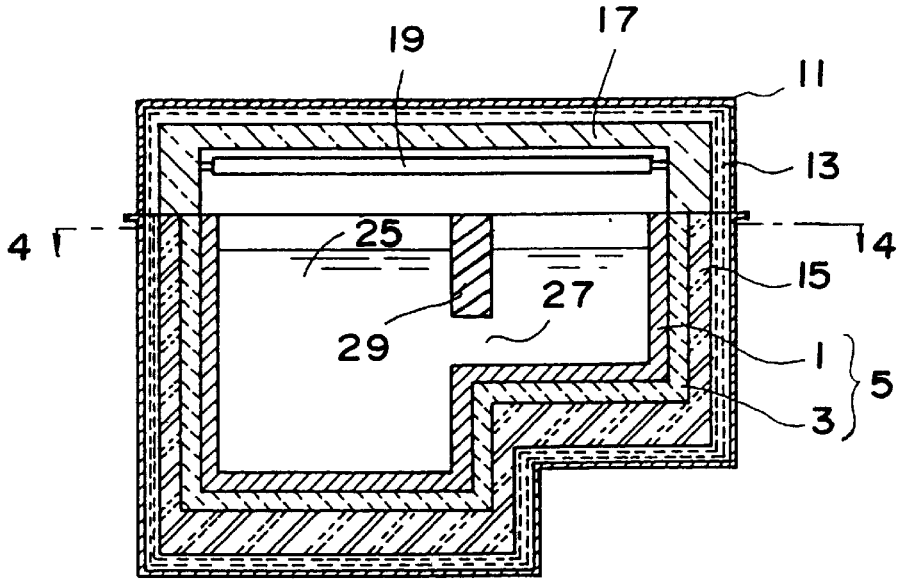
FIG. 3 is a view in vertical section showing another embodiment of molten metal holding furnace according to the invention.
Figure 4:
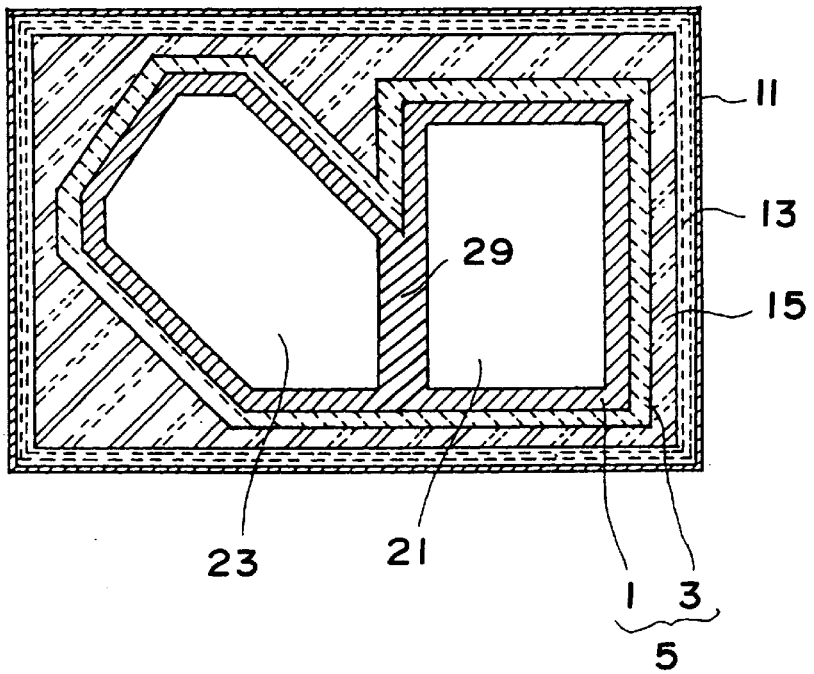
FIG. 4 is a view in section taken along the line 4—4 in FIG. 3.

FIGS. 3 and 4 show another embodiment of the invention, wherein the interior of a molten metal vessel 5 is divided by a partition 29 into an inlet vessel portion 21 and an outlet vessel portion 23. Molten metal 25 is movable from the inlet vessel portion 21 toward the outlet vessel portion 23 through a opening 27 under the partition 29.

The partition 29, which is provided by a nonoxide-containing fired casting, is usually formed integrally with the inner vessel layer 1 and thereafter sintered. Alternatively, the partition may be formed and sintered separately from the inner vessel layer 1, and fitted to the layer 1 for installation.

With the holding furnace shown in FIGS. 2 and 3, the secondary heat-insulating layer 15 can be dispensed with depending on the conditions for use.

The present invention has the remarkable advantages described below.

(1) The molten metal vessel of double-layer structure has high resistance to thermal impact and to corrosion and is therefore almost free of cracking during use. The vessel is less reactive with molten metals, fluxes and slags, and accordingly produces no hard spots, affording castings of metals, such as aluminum, in improved yields.

In cleaning the holding furnace after a predetermined period of operation, power-driven tools are usable for removing deposits from the inside wall because the inner vessel layer providing the surface to be in contact with the molten metal is made of a nonoxide-containing fired casting which has exceedingly high strength.

(2) The calcium silicate refractory positioned on the rear side of the nonoxide-containing fired casting providing the melt contact surface is excellent in heat resistance and heat-insulating properties, such that should the inner vessel 1 develop a crack or become damaged during installation or use, there is no likelihood of the molten metal leaking out to ensure work or operation with higher safety.

(3) The inner vessel 1 providing the melt contact surface of the holding furnace has high thermal conductivity, while the superinsulation material forming the outer heat-insulating layer has extremely high heat-insulating properties. This feature results in a greatly diminished molten metal temperature difference inside the molten metal vessel. (The difference can be up to 3° C. although dependent on the size, shape and operating conditions of the holding furnace.) The lining wall is therefore given remarkably improved heat-insulating properties, materially reducing the dissipation of heat from the furnace outer wall.

(4) The advantage (3) leads to smaller power consumption for holding the molten metal upper layer at the delivery temperature than in the conventional holding furnaces, also permitting use of a lining wall of decreased thickness.

(5) The molten metal vessel of double-Layer structure can be prepared in advance by an independent process under closely controlled conditions instead of being built up at the site of installation. This assures the vessel of a stabilized quality.

(6) The molten metal vessel of double-layer structure is packaged with bands attached thereto to serve as hanging means, transported to the installation site and installed inside a heat-insulating layer of ceramic board layer provided in the interior of a shell case in advance, whereby the vessel can be readily incorporated into a molten metal holding furnace. The bands need not be removed but can be left as they are.

(7) The holding furnace can be completely constructed or repaired within a short period of time without necessitating highly skilled workers.

Especially, the furnace can be repaired at a greatly reduced cost merely by replacing the molten metal vessel only.

(8) Since no water is used for the lining work, there is no need to dry the interior of the furnace before operation. This also serves to shorten the work time.

EXAMPLE

An example is given below for a better understanding of the features of the invention.

Example 1

A molten metal vessel 5 of double-layer structure was prepared first which was of the type shown in FIGS. 3 and 4.

A box-shaped vessel casting having an open side was obtained by making a mold of expanded polystyrene first, pouring a silicon carbide monolithic refractory (brand name "SICTEX," product of Nippon Crucible Co., Ltd., SiC 90%, $Al_2O_3$ 4%, $SiO_2$ 3%) into the mold, and curing, solidifying and drying the refractory, followed by removal of the mold. The casting was fired at about 1000° C. to obtain an inner vessel layer 1 formed with a partition 29 integrally therewith. The inner vessel layer 1 obtained by casting and sintering was 900kg/$m^2$ in compressive strength, 2.59 in bulk density and 8 kcal/m.hr. °C. in thermal conductivity.

Subsequently, the inner vessel layer 1 obtained was placed as turned upside down into a mold of foam polystyrene shaped in conformity with the contour of the molten metal vessel to be prepared, and a slurry of calcium silicate monolithic refractory (brand name "AL-79," product of Nippon Crucible Co., Ltd., $Al_2O_3$ 34%, $SiO_2$ 30%, CaO 34%) was poured into the mold to form an outer layer around the inner vessel layer 1 by casting. The outer layer was cured and solidified, followed by removal of the mold and drying at about 260° C. to form an outer vessel layer 3 of calcium silicate refractory and prepare a molten metal vessel 5 of double-layer structure. The vessel 5 obtained was 105 kg/$m^2$ in compressive strength, 1.45 in bulk density and 0.4 kcal/m.hr. °C. in thermal conductivity.

Bands made of polypropylene resin fibers and shown in FIG. 1 were then provided around the molten metal vessel 5 of double-layer structure obtained, and the vessel 5 was packaged and transported to a site of installation to build up at site a molten metal holding furnace (1880 mm×1300 mm×1170 mm high, 1500 kg in capacity) for die-casting having the construction shown in FIGS. 3 and 4.

More specifically, the vessel 5 was installed in a shell case 11 after covering the inner side wall and bottom wall of the case 11 with a superinsulation refractory (brand name "MICROTHERM," product of Nippon Microtherm Co., Ltd., 0.03 kcal/m.hr. °C. in thermal conductivity) to a thickness of 45 mm as a primary heat-insulating layer 13, and further laying silica board, about 100 mm in thickness (0.065 kcal/m.hr. °C. in thermal conductivity) over the layer 13 to form a secondary heat-insulating layer 15.

The construction work of the present invention was carried out with ease within a much shorter period of time than conventionally without necessitating highly skilled workers.

When the furnace thus built was actually used for holding molten aluminum, the operation achieved the foregoing advantages.

What is claimed is:

1. A molten metal vessel characterized in that the vessel has a double-layer structure which comprises an inner vessel layer in the form of a nonoxide-containing fired casting, and an outer vessel layer formed from a calcium silicate refractory around the inner vessel layer integrally therewith by casting.

2. A molten metal vessel according to claim 1 which is characterized in that the inner vessel layer of nonoxide-containing fired casting is obtained by firing in a reduction atmosphere a box-shaped vessel having an open upper side and prepared by casting an monolithic refractory consisting primarily of a silicon carbide material or silicon nitride material.

3. A molten metal vessel according to claim 1 which is characterized in that the outer vessel layer of calcium silicate refractory is obtained by casting a calcium silicate monolithic refractory around the inner vessel layer, and thereafter curing, solidifying and drying the resulting casting.

4. A molten metal vessel according to claim 1 which is characterized in that the inner vessel layer is divided into an inlet vessel portion and an outlet vessel portion by a partition of nonoxide-containing fired casting, and molten metal within the inlet vessel portion is movable toward the outlet vessel portion through an opening under the partition.

5. A molten metal vessel according to claim 2 which is characterized in that the silicon carbide material or the silicon nitride material contains at least 80 wt. % of silicon carbide or silicon nitride.

6. A molten metal holding furnace characterized in that the furnace comprises a molten metal vessel installed inside a shell case, at least with a primary heat-insulating layer of superinsulation material provided between the vessel and the shell case, the vessel comprises an inner vessel layer of nonoxide-containing fired casting, and an outer vessel layer formed from a calcium silicate refractory around the inner vessel layer integrally therewith by casting.

7. A molten metal holding furnace according to claim 6 which is characterized in that the inner vessel layer of nonoxide-containing fired casting is obtained by firing in a reduction atmosphere a box-shaped vessel having an open upper side and prepared by casting a monolithic refractory consisting primarily of a silicon carbide material or silicon nitride material.

8. A molten metal holding furnace according to claim 6 which is characterized in that the outer vessel layer of calcium silicate refractory is obtained by casting a calcium silicate monolithic refractory around the inner vessel layer, and thereafter curing, solidifying and drying the resulting casting.

9. A molten metal holding furnace according to claim 6 which is characterized in that the inner vessel layer is divided into an inlet vessel portion and an outlet vessel portion by a partition of the same material as the inner vessel layer, and molten metal within the inlet vessel portion is movable toward the outlet vessel portion through an opening under the partition.

10. A molten metal holding furnace according to claim 7 which is characterized in that a secondary heat-insulating layer of ceramic board is provided between the vessel and the primary heat-insulating layer of superinsulation material.

11. A molten metal holding furnace according to claim 6 which is characterized in that the superinsulation material is up to 0.03 kcal/m.hr. °C. in thermal conductivity.

* * * * *